US010121303B2

(12) United States Patent
Xu et al.

(10) Patent No.: US 10,121,303 B2
(45) Date of Patent: Nov. 6, 2018

(54) CASHBOX AND SELF-SERVICE TERMINAL DEVICE USING CASHBOX

(71) Applicant: Shandong New Beiyang Information Technology Co., Ltd., Shandong (CN)

(72) Inventors: Fang Xu, Shandong (CN); Tao Gao, Shandong (CN); Shishui Zhang, Shandong (CN); Fengbo Xu, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 179 days.

(21) Appl. No.: 14/891,168

(22) PCT Filed: May 26, 2014

(86) PCT No.: PCT/CN2014/078451
§ 371 (c)(1),
(2) Date: Nov. 13, 2015

(87) PCT Pub. No.: WO2014/194775
PCT Pub. Date: Dec. 11, 2014

(65) Prior Publication Data

US 2016/0086414 A1 Mar. 24, 2016

(30) Foreign Application Priority Data

Jun. 7, 2013 (CN) ..... 2013 1 0225862

(51) Int. Cl.
*G07D 11/00* (2006.01)
*G07F 7/04* (2006.01)

(52) U.S. Cl.
CPC ..... *G07D 11/0006* (2013.01); *G07D 11/0009* (2013.01); *G07F 7/04* (2013.01)

(58) Field of Classification Search
CPC .. G07D 11/0006; G07D 11/0009; G07F 7/04; G07F 19/20; G07F 19/201; G07F 9/06; A45C 1/12; E05G 1/005; E05G 1/02
(Continued)

(56) References Cited

U.S. PATENT DOCUMENTS 6,712,352 B2 * 3/2004 Bergeron ..... G07D 11/0009 232/15
7,837,095 B2 * 11/2010 Clauser ..... G07D 11/0009 194/350
(Continued)

FOREIGN PATENT DOCUMENTS

CN 1220855 A 6/1999
CN 2748987 Y 12/2005
(Continued)

OTHER PUBLICATIONS

International Search Report issued by the State Intellectual Property Office of the People's Republic of China as International Searching Authority for International Application No. PCT/CN2014/078451 dated Sep. 9, 2014 (8 pages).

*Primary Examiner* — William L Miller
(74) *Attorney, Agent, or Firm* — Wilmer Cutler Pickering Hale and Dorr LLP

(57) ABSTRACT

A cashbox having a rectangular cuboid structure, wherein external walls of the cashbox comprise a left box wall (21) and a right box wall (22) arranged oppositely, a front box wall (24) and a rear box wall arranged oppositely, and a top wall (23) and a bottom wall arranged oppositely, wherein slots (26; 27) are respectively provided on two box walls which are of the external walls, arranged oppositely and parallel to an inserting direction of the cashbox, and both ends of each of the slots (26; 27) in the inserting direction are inserting openings.

9 Claims, 6 Drawing Sheets

(58) Field of Classification Search
USPC ..... 232/1 D, 4 R, 15, 16; 194/350; 902/9; 109/47, 52; 235/379; 206/0.81
See application file for complete search history.

(56) References Cited

U.S. PATENT DOCUMENTS

| | | | | |
|---|---|---|---|---|
| 7,878,318 | B2 * | 2/2011 | Nunn | G07D 11/0009 194/350 |
| 8,783,552 | B2 * | 7/2014 | Xu | G07D 11/0006 109/52 |
| 8,844,705 | B2 * | 9/2014 | Braukmann | G07D 9/00 194/350 |
| 2016/0086414 | A1 * | 3/2016 | Xu | G07F 7/04 232/4 R |

FOREIGN PATENT DOCUMENTS

| | | | |
|---|---|---|---|
| CN | 201039632 | Y | 3/2008 |
| CN | 102324135 | A | 1/2012 |
| CN | 202736153 | U | 2/2013 |
| JP | 3219665 | B2 | 10/2001 |
| JP | 2012174004 | A | 9/2012 |

* cited by examiner

CASHBOX AND SELF-SERVICE TERMINAL DEVICE USING CASHBOX

CROSS-REFERENCE TO RELATED APPLICATIONS

This application is a National Stage Entry of PCT International Application No. PCT/CN2014/078451 filed May 26, 2014, which claims priority to Chinese patent application No. 201310225862.X, entitled "Cashbox and Self-service Terminal Device Using Cashbox", filed on Jun. 7, 2013 with the State Intellectual Property Office of China, the disclosure of which is incorporated herein by reference in its entirety.

TECHNICAL FIELD

The present disclosure relates to a cashbox and a self-service terminal device using the cashbox.

BACKGROUND

A self-service terminal device, such as a self-service vending machine, a self-service ticket machine and an automated teller machine, is provided therein with a money recognizing mechanism and a cashbox. The money recognizing mechanism is fixedly connected to a bracket in the self-service terminal device, and the cashbox is detachably connected with the bracket in the self-service terminal device. After the cashbox is installed in the bracket in the self-service terminal device, a money inlet of the money recognizing mechanism is in communication with a money inlet on a panel of the self-service terminal device, and a money outlet of the money recognizing mechanism is connected to a money inlet of the cashbox. In this way, money (such as coins or cashes) can be put into the money inlet of the self-service terminal device, and enters into the money recognizing mechanism via the money inlet of the money recognizing mechanism, so that the money recognizing mechanism recognizes feature information of the money to identify whether the money is genuine or fake. When being identified as genuine by the money recognizing mechanism, the money is outputted from the money outlet of the money recognizing mechanism and transferred into the cashbox via the money inlet of the cashbox for the purpose of storage. After being filled with the money, the cashbox is removed from the bracket by an operator and transferred by a supercargo to a processing center for checking off. At the same time, an empty cashbox is instead installed in the bracket.

As shown in FIG. 1*a* and FIG. 1*b* which illustrate a connection structure between the existing cashbox and the bracket, two grooves 31' with a preset length are symmetrically arranged at left and right sides of a cashbox 2', and an opening end of each of the grooves 31' is provided with a positioning notch 311'. Further, two guide rails 32' matching with the respective grooves 31' are respectively arranged at left and right sides of the bracket 1', and a positioning member 321' which is elastically retractable in an up-and-down direction and matches with the positioning notch 311' is arranged on each of the guide rails 32', so that when the cashbox 2' is being installed into the bracket 1' in a front-to-rear direction, the grooves 31' match with the respective guide rails 32' in a plugging manner and hence each positioning member 321' is forced to retract; subsequently, as the cashbox 2' is moved forward into the bracket 1', when a blind end of the groove 31' contacts the leading end of the guide rail 32', the positioning member 321' on the guide rail 32' faces the positioning notch 311' in the groove 31' so that the positioning member 321' protrudes and matches with the positioning notch 311' in a plugging manner for the purpose of positioning, thereby locking the cashbox 2' into the bracket 1'.

Depending on application environment requirements for the self-service terminal device, the cashbox is required to be installed into or removed from the bracket from either a front side or a rear side of the bracket, for example, in the case of a self-service terminal device used in the lobby of a bank (i.e. a self-service terminal device maintained at its front side), the cashbox is required to be installed into or removed from the bracket from a front side of the bracket, while in the case of a self-service terminal device installed in the wall of a bank (i.e. a self-service terminal device maintained at its rear side), the cashbox is required to be installed into or removed from the bracket from a rear side of the bracket. However, the above-described cashbox is designed to be installed into or removed from the bracket only the front side of the self-service terminal device. Therefore, to meet the requirement that the cashbox is installed into or removed from the bracket from the rear side of the self-service terminal device, the connection structure on the bracket of the self-service terminal device needs to be altered, or two different types of cashboxes are respectively required for these different installing manners, thereby increasing costs for the user in either case, that is, the existing cashbox is poor in applicability to the application environment.

SUMMARY OF THE INVENTION

An object of the present disclosure is to provide a cashbox which is very adaptive to an application environment, and also an object of the present disclosure is to provide a self-service terminal device using the cashbox.

To this end, an aspect of the present disclosure provides a cashbox having a rectangular cuboid structure, where external walls of the cashbox include a left box wall and a right box wall arranged oppositely, a front box wall and a rear box wall arranged oppositely, and a top wall and a bottom wall arranged oppositely, where slots are respectively provided on two box walls which are of the external walls, arranged oppositely and parallel to an inserting direction of the cashbox, and both ends of each of the slots in the inserting direction are inserting openings.

Further, positions of the two slots on the two box walls are staggered in a direction perpendicular to the inserting direction of the cashbox, to prevent reversed installation of the cashbox.

Further, one of the two slots is arranged on the left box wall and the other of the two slots is arranged on the right box wall, and positions of the two slots on the left box wall and the right box wall are staggered in a height direction of the cashbox.

Further, each of the inserting openings has a tapered shape.

Further, handling recesses configured for inserting and pulling the cashbox and formed by recessed regions are arranged on the external walls.

Further, a positioning notch or a retractable positioning pin is arranged on an upper or lower edge of each of the slots.

Another aspect of the present disclosure provides a self-service terminal device, including a money recognizing mechanism, a cashbox of any one of the claims, and a bracket for installing the money recognizing mechanism and the cashbox, where bar-shaped protrusions configured to match with the slots on the cashbox in a plugging manner are arranged on the bracket.

Further, one of a positioning notch and a retractable positioning pin is arranged on an upper or lower edge of each of the slots, the other of the positioning notch and the retractable positioning pin is arranged on the bar-shaped protrusions, and the positioning notch and the retractable positioning pin are configured to match with each other in a plugging manner or separate from each other.

Further, the bracket includes a left side wall, a right side wall, a bottom plate and an intermediate baffle plate, the money recognizing mechanism is located above the intermediate baffle plate and between the left side wall and the right side wall, the cashbox is located below the intermediate baffle plate and between the left side wall and the right side wall, handling recesses configured for inserting and pulling the cashbox and formed by recessed regions are arranged on the left box wall and the right box wall of the cashbox, and collision-avoiding notches configured to avoid a collision with the handling recesses are arranged on the left side wall and the right side wall.

The present disclosure further provides a self-service terminal device, including a bracket, and a money recognizing mechanism and a cashbox installed in the bracket, where slots are arranged on one of the cashbox and the bracket, and bar-shaped protrusions configured to match with the slots in a plugging manner are arranged on the other of the cashbox and the bracket, and wherein, both ends of each of the slots in an inserting direction of the cashbox are inserting openings, a number of the slots is two, the slots are distributed on two opposite box walls which are from external walls of the cashbox and parallel to the inserting direction, and positions of the two slots are staggered in a direction perpendicular to the inserting direction, to prevent reversed installation of the cashbox.

As such, both ends of each of the slots provided on two opposite box walls parallel to an inserting direction of the cashbox provided in the present disclosure are inserting openings, thus the slots can bidirectionally match with the bar-shaped protrusions on the bracket in a plugging manner, and hence the cashbox can be bidirectionally installed in the bracket. In addition, the positions of the slots on the two opposite box walls of the cashbox relative to the box walls are staggered, so that the potential reversed installation of the cashbox due to a change of the installation direction of the cashbox is avoided.

In addition to the above-described objects, features and advantages, other objects, features and advantages of the present disclosure will be further described in detail below in combination with the accompanying drawings.

BRIEF DESCRIPTION OF THE DRAWINGS

Accompanying drawings, which construct a part of the specification and are used for better understanding of the present disclosure, illustrate some preferred embodiments of the present disclosure, and show principles of the present disclosure in combination with the description below.

LIST OF REFERENCE NUMERALS

| | |
|---|---|
| 1. Money recognizing mechanism | 2. Cashbox |
| 21. Left box wall | 22. Right box wall |
| 23. Top wall | 24. Front box wall |
| 25. Handling recess | 26. First slot |
| 27. Second slot | 261. First notch |
| 271. Second notch | 8. Bracket |
| 81. Left side wall | 82. Right side wall |
| 84. Bottom plate | 85. Intermediate plate |
| 86. First bar-shaped protrusion | 87. Second bar-shaped protrusion |
| 811. First avoiding notch | 821. Second avoiding notch |
| 861. First positioning pin | 861a. Positioning part |
| 861b. Limiting part | 861c. Elastic support part |

DETAILED DESCRIPTION OF THE EMBODIMENTS

Embodiments of the present disclosure are described in detail below in combination with the accompanying drawings, although the present disclosure can be implemented in various ways defined and covered by the appended claims.

Figure 1A:
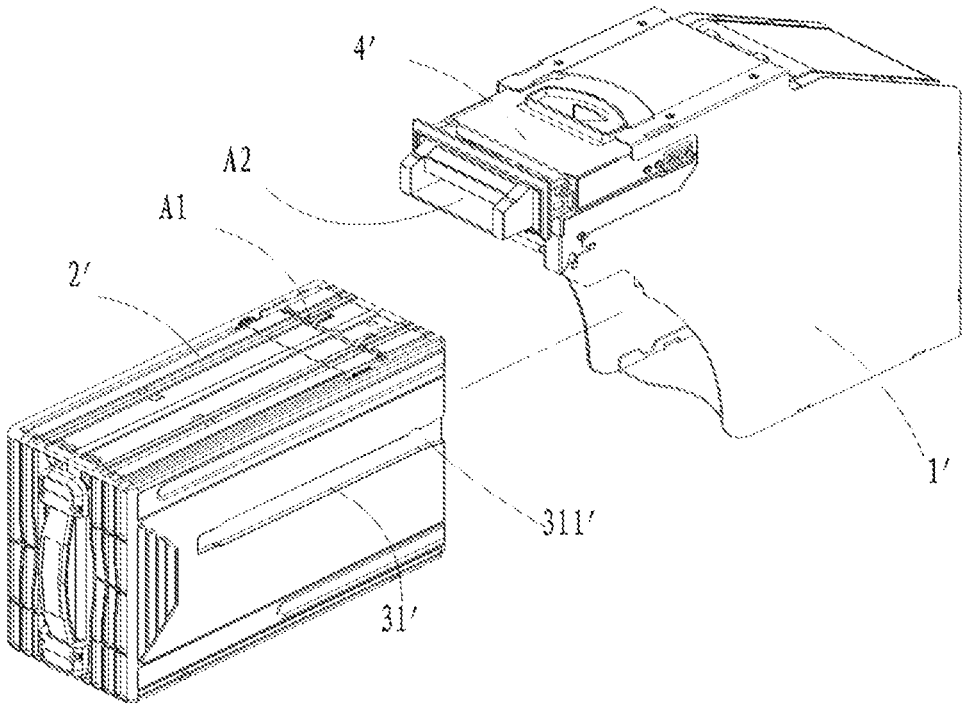
Fig. 1a (Prior Art)
FIG. 1*a* is a view of installing of a cashbox of a self-service terminal device in the related art.
Figure 1B:
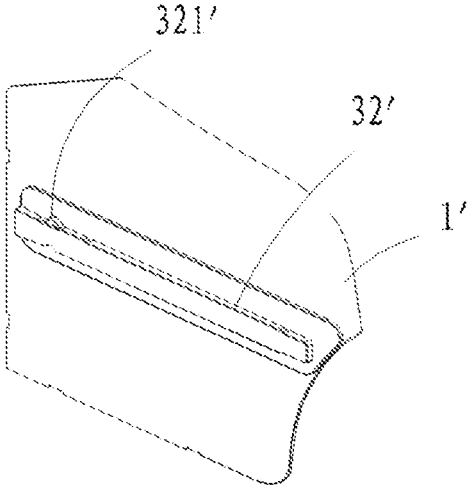
Fig. 1b (Prior Art)
FIG. 1*b* is a partial structural view of a bracket of the self-service terminal device shown in FIG. 1*a;*
Figure 2A:
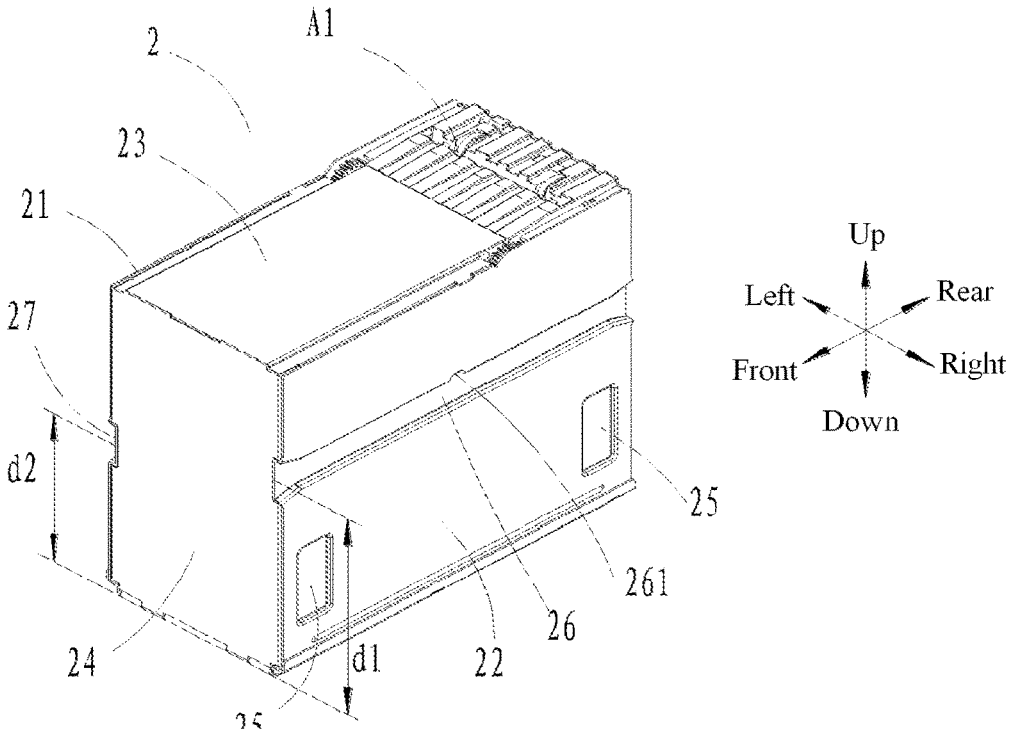
FIG. 2*a* is a first isometric view of a cashbox according to an embodiment of the present disclosure.
Figure 2B:
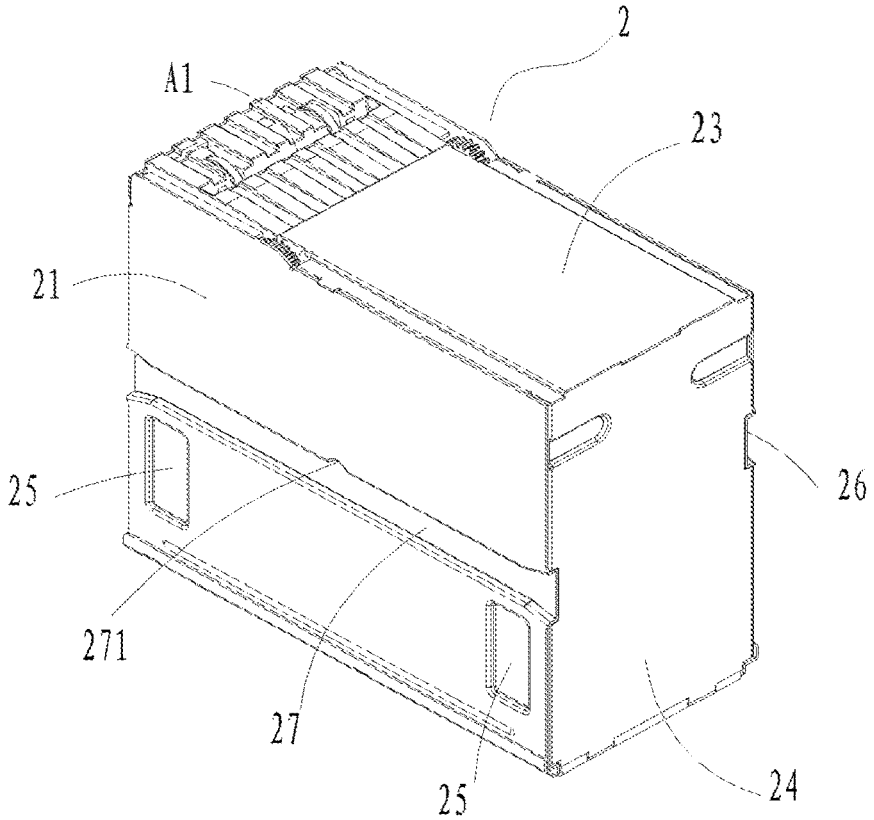
FIG. 2*b* is a second isometric view of a cashbox according to an embodiment of the present disclosure.

FIG. 2*a* is a first isometric view of a cashbox according to an embodiment of the present disclosure, and FIG. 2*b* is a second isometric view of a cashbox according to an embodiment of the present disclosure. As shown in FIG. 2*a* and FIG. 2*b*, a cashbox 2 generally has a rectangular cuboid structure, and external walls of the cashbox 2 include a left box wall 21, a right box wall 22, a top wall 23, a bottom wall (not shown), a front box wall 24, and a rear box wall (not shown). The top wall 23 and the bottom wall are parallel to each other and spaced from each other by a predefined distance, the left box wall 21 and the right box wall 22 are parallel to each other and spaced from each other by a predefined distance, and the front box wall 24 and the rear box wall are parallel to each other and spaced from each other by a predefined distance, as such, the left box wall 21, the right box wall 22, the top wall 23, the bottom wall, the front box wall 24, and the rear box wall together construct the six faces of a rectangular cuboid. A money inlet A1 is arranged at an end of the top wall 23 close to the rear box wall. The money inlet A1 extends in a longitudinal direction perpendicular to the left box wall 21 and the right box wall 22, and has a length and a width respectively matching with the width and the thickness of money. To be installed into the bracket of the self-service terminal device, the cashbox 2 may be installed into the bracket from the front side of the bracket in a front-to-rear direction, or may be installed into the bracket from the rear side of the bracket in a rear-to-front direction.

A first connection mechanism is provided on two opposite box walls of the cashbox 2 which are from the external walls of the cashbox 2 and parallel to an inserting direction of the cashbox 2, and is configured to connect with the bracket of the self-service terminal device. Herein, the two opposite box walls of the cashbox 2 which are parallel to the inserting direction of the cashbox 2 may be the left box wall 21 and the right box wall 22 of the cashbox 2, or may be the top wall 23 and the bottom wall of the cashbox 2, that is, the first connection mechanism may be arranged on the outside of the left box wall 21 and the right box wall 22 of the cashbox 2, or may be arranged on the outside of the top wall 23 and the bottom wall of the cashbox 2. The first connection mechanism includes a first guide member and a first positioning member, where the first guide member may be one of a slot and a bar-shaped protrusion, and the first positioning member may be one of a notch and a positioning pin. In the present embodiment, the first connection mechanism is arranged on the outside of the left box wall 21 and the right box wall 22 of the cashbox 2, the first guide member includes a first slot 26 arranged on the right box wall 22 and a second slot 27 arranged on the left box wall 21, and the first positioning member includes a first notch 261 arranged in the first slot 26 and a second notch 271 arranged in the second slot 27, where both ends of each of the first slot 26 and the second slot 27 in the inserting direction of the cashbox 2 are inserting openings.

The first slot 26 is fixedly arranged on the outer surface of the right box wall 22, extends toward the inner of the cashbox 2, and has a longitudinal direction parallel to the installing direction of the cashbox, i.e. a front-and-rear direction as indicated by a coordinate system shown in FIG. 2*a*. In addition, the first slot 26 extends through the front box wall 24 of the cashbox 2 and the rear box wall of the cashbox 2, has a defined width and a defined depth, and has two tapered opening ends in its longitudinal direction. The second slot 27 is fixedly arranged on the outer surface of the left box wall 21, extends toward the inner of the cashbox 2, and has a longitudinal direction parallel to the longitudinal direction of the first slot 26. In addition, the second slot 27 extends through the front box wall 24 of the cashbox 2 and the rear box wall of the cashbox 2, has a defined width and a defined depth, and has two tapered opening ends in its longitudinal direction.

Preferably, a sign is attached to the outer surface of the top wall 23 of the cashbox 2, to prompt a user about an installing direction of the cashbox.

Preferably, positions of the slots on the opposite box walls of the cashbox 2 are staggered in a direction perpendicular to the inserting direction of the cashbox 2, to prevent reversed installation of the cashbox 2 into the bracket. For example, when the first connection mechanism is arranged on the left box wall 21 and the right box wall 22 of the cashbox 2, a distance d1 between the first slot 26 and the bottom wall is unequal to a distance d2 between the second slot 27 and the bottom wall, that is, d1≠d2. When the first connection mechanism is arranged on the top wall 23 and the bottom wall of the cashbox 2, a distance d3 between the first slot 26 and the left box wall 21 is unequal to a distance d4 between the second slot 27 and the left box wall 21. In this arrangement, no matter whether the cashbox 2 is installed into the bracket in the front-to-rear direction or the rear-to-front direction, the first slot 26 and the second slot 27 on the cashbox 2 can be properly fitted with a matching structure on the bracket only if the position of the money inlet A1 of the cashbox 2 relative to the bracket is unchanged, thereby avoiding potential reversed installation of the cashbox due to a change of the installation direction of the cashbox, and ensuring that the position of the money inlet A1 of the cashbox 2 relative to the bracket is unchanged regardless of the inserting direction of the cashbox 2.

The first notch 261 is positioned at an upper or lower edge of the first slot 26 and extends in a direction perpendicular to the inserting direction of the cashbox; preferably, the first notch 261 is positioned in the middle of the first slot 26 in the longitudinal direction of the first slot 26. The second notch 271 is positioned at an upper or lower edge of the second slot 27 and extends in a direction perpendicular to the inserting direction of the cashbox; preferably, the second notch 271 is positioned in the middle of the second slot 27 in the longitudinal direction of the second slot 27.

Preferably, handling recesses 25 extending toward the inner of the cashbox 2 are disposed on the outer surfaces of the left box wall 21 and/or the right box wall 22 of the cashbox 2, and are configured for handling by a user to install or remove the cashbox 2. In the present embodiment, two handling recesses 25 are provided on each of the left box wall 21 and the right box wall 22 of the cashbox 2, where the two handling recesses 25 on the left box wall 21 are respectively close to the front box wall 24 and the rear box wall of the cashbox 2, and those two handling recesses 25 on the right box wall 22 are arranged symmetrically with those two handling recesses 25 on the left box wall 21 with respect to a center of width between the left box wall 21 and the right box wall 22.

As above, the slots are respectively provided on two opposite box walls of the cashbox which are parallel to the inserting direction of the cashbox according to the present disclosure, and both ends of each of the slots in the inserting direction of the cashbox are inserting openings, so that in installing the cashbox in the present disclosure into the bracket of the self-service terminal device, the cashbox may be installed into the bracket from the front side of the bracket in the front-to-rear direction, or may be installed into the bracket from the rear side of the bracket in the rear-to-front direction, thus the cashbox in the present disclosure is very adaptive to the application environment. Furthermore, these two slots on the opposite box walls of the cashbox are staggered in a direction perpendicular to the inserting direction of the cashbox, therefore, in installing the cashbox into the bracket of the self-service terminal device, the slots on the cashbox can be properly fitted with the bar-shaped protrusions on the bracket only if the position of the money inlet of the cashbox relative to the bracket is unchanged, thereby avoiding potential reversed installation of the cashbox due to a change of the installation direction of the cashbox, and ensuring the proper use of the cashbox. Therefore, the cashbox in the present disclosure has high reliability.

Figure 3:
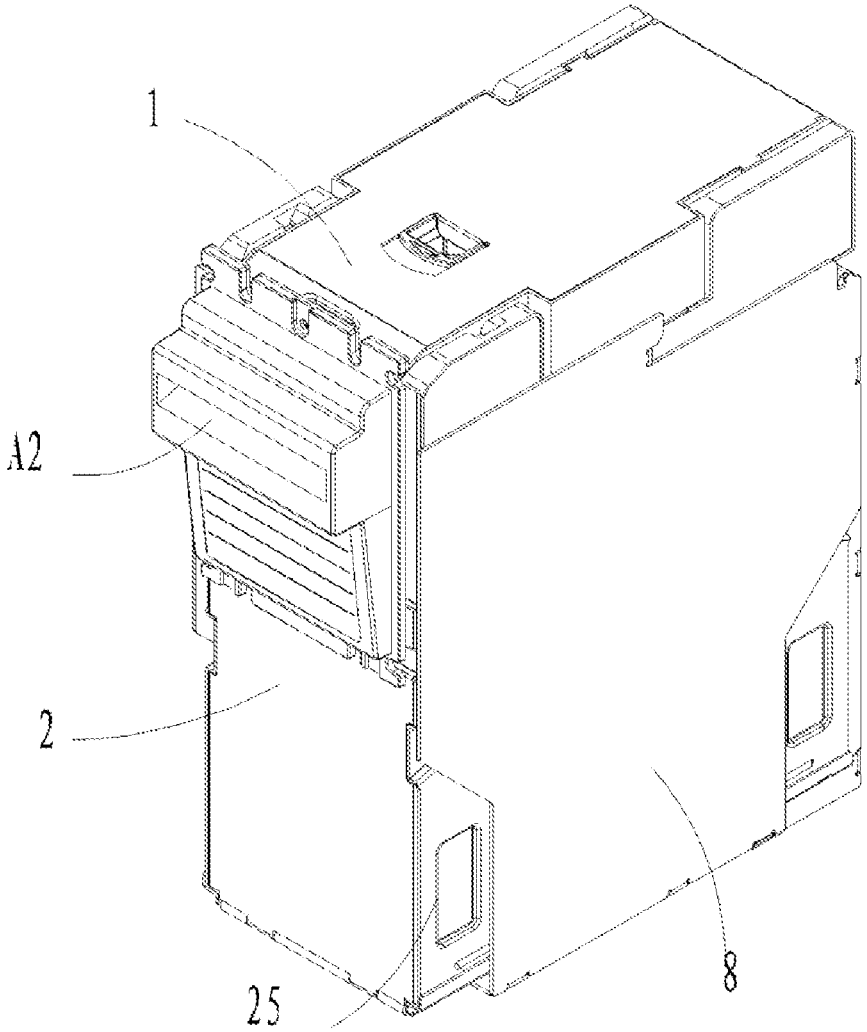
FIG. 3 is a partial structural view of a self-service terminal device using the cashbox according to an embodiment of the present disclosure.
Figure 4:
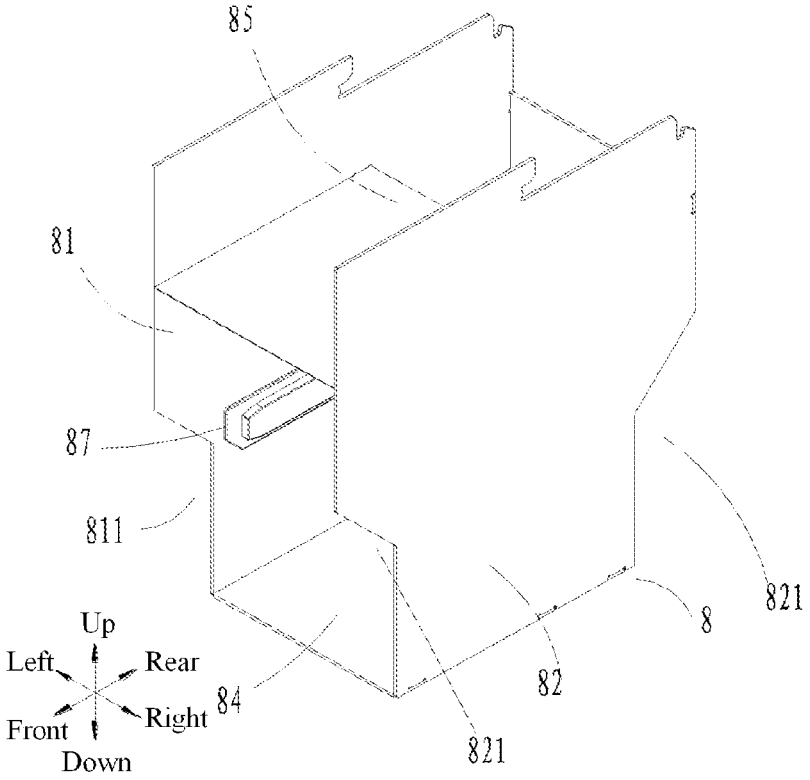
FIG. 4 is a structural view of a bracket of the self-service terminal device using the cashbox according to the embodiment of the present disclosure.

FIG. 3 is a schematic diagram showing a partial structure of a self-service terminal device using the cashbox according to the embodiment of the present disclosure, and FIG. 4 is a structural view of a bracket of the self-service terminal device using the cashbox according to the embodiment of the present disclosure. As shown in FIG. 3 and FIG. 4, the self-service terminal device in the present embodiment includes a money recognizing mechanism 1, a cashbox 2, and a bracket 8.

The bracket 8, which is configured to support the money recognizing mechanism 1 and the cashbox 2, includes a left side wall 81, a right side wall 82, a bottom plate 84, an intermediate plate 85, and a second connection mechanism. The left side wall 81 and the right side wall 82 are parallel to each other, and a distance between an inner surface of the left side wall 81 and an inner surface of the right side wall 82 matches a distance between an outer surface of the left box wall 21 of the cashbox 2 and an outer surface of the right box wall 22 of the cashbox 2. The intermediate plate 85 and the bottom plate 84 are parallel to each other, and are supported perpendicularly on and between the left side wall 81 and the right side wall 82, and a distance between an inner surface of the intermediate plate 85 and an inner surface of the bottom plate 84 matches a distance between an outer surface of the top wall 23 of the cashbox 2 and an outer surface of the bottom wall of the cashbox 2. Preferably, a first avoiding notch 811 and a second avoiding notch 821 are respectively arranged at front and rear ends of each of the left side wall 81 and the right side wall 82 of the bracket 8 close to the bottom plate 84, to avoid the handling recesses 25 on the cashbox 2, for the purpose of ease installation or removal of the cashbox 2.

Figure 5:
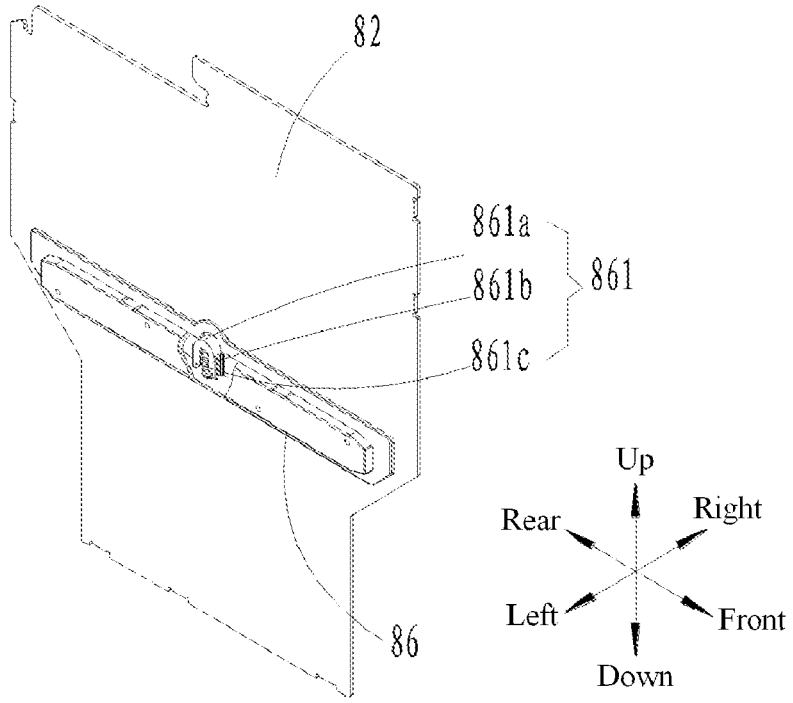
FIG. 5 is a partial structural section view of the bracket of the self-service terminal device using the cashbox according to the embodiment of the present disclosure.

FIG. 5 is a partial section structural view of the bracket of the self-service terminal device using the cashbox according to the embodiment of the present disclosure. As shown in FIG. 4 and FIG. 5, the second connection mechanism on the bracket 8 is configured to be detachably connected with the cashbox 2. Depending on the position of the first connection mechanism on the cashbox 2, the second connection mechanism may be arranged on the inner sides of the left side wall 81 and the right side wall 82 of the bracket 8, or may be alternatively arranged on the inner sides of the intermediate plate 85 and the bottom plate 84 of the bracket 8. For example, when the first connection mechanism on the cashbox 2 is arranged on the outer sides of the left box wall 21 and the right box wall 22 of the cashbox 2, the second connection mechanism is arranged on the inner sides of the left side wall 81 and the right side wall 82 of the bracket 8; and when the first connection mechanism on the cashbox 2 is arranged on the outer sides of the top wall 23 and the bottom wall of the cashbox 2, the second connection mechanism is arranged on the inner sides of the intermediate plate 85 and the bottom plate 84 of the bracket 8. In the present embodiment, the second connection mechanism is arranged on the inner sides of the left side wall 81 and the right side wall 82 of the bracket 8.

The second connection mechanism includes a second guide member and a second positioning member, where the second guide member matches with the first guide member on the cashbox 2 in a plugging manner and is configured to limit the cashbox 2 to be movable relative to the bracket 8 merely in the installing direction of the cashbox 2, and the second positioning member matches with the first positioning member on the cashbox 2 in a plugging manner and is configured to lock the position of the cashbox 2 relative to the bracket 8 in the installing direction of the cashbox 2. When the first guide member on the cashbox 2 is a slot, the second guide member is a bar-shaped protrusion matching with the slot, and when the first guide member on the cashbox 2 is a bar-shaped protrusion, the second guide member is a slot matching with the bar-shaped protrusion. When the first positioning member on the cashbox 2 is a notch, the second positioning member on the bracket 8 is a positioning pin matching with the notch, and when the first positioning member on the cashbox 2 is a positioning pin, the second positioning member on the bracket 8 is a notch matching with the positioning pin. In the present embodiment, the second guide member includes a first bar-shaped protrusion 86 arranged on the right side wall 82 of the bracket 8 and a second bar-shaped protrusion 87 arranged on the left side wall 81 of the bracket 8, and the second positioning member includes a first positioning pin 861 arranged on the first bar-shaped protrusion 86 and a second positioning pin (not shown) arranged on the second bar-shaped protrusion 87.

The first bar-shaped protrusion 86 is fixedly arranged on the inner surface of the right side wall 82 of the bracket 8, protrudes from the inner surface of the right side wall 82, and extends in its longitudinal direction parallel to the installing direction of the cashbox (i.e. a front-and-rear direction as shown in FIG. 5) for a preset length. The first bar-shaped protrusion 86 has a width and a height respectively matching with the width and the depth of the first slot 26 on the cashbox 2, and the first bar-shaped protrusion 86 matches with the first slot 26 in a plugging manner. The second bar-shaped protrusion 87 is fixedly arranged on the inner surface of the left side wall 81 of the bracket 8, protrudes from the inner surface of the left side wall 81, has a longitudinal direction parallel to the longitudinal direction of the first bar-shaped protrusion 86 and has a preset length. The second bar-shaped protrusion 87 has a width and a height respectively matching with the width and the depth of the second slot 27, and the second bar-shaped protrusion 87 matches with the second slot 27 in a plugging manner.

The first positioning pin 861 is located in a cavity of the first bar-shaped protrusion 86, is movable along a direction perpendicular to the installing direction of the cashbox (i.e. an up-and-down direction as shown in FIG. 5), and is configured to match with the first notch 261 in the first slot 26 in a plugging manner or be separated from the first notch 261 in the first slot 26. The first positioning pin 861 includes a positioning part 861*a*, a limiting part 861*b*, and an elastic support part 861*c*, where the limiting part 861*b* is located within the cavity, the positioning part 861*a* is fixedly connected with the limiting part 861*b* and is protrudable through an opening in the first bar-shaped protrusion 86 from the surface of the first bar-shaped protrusion 86, and the elastic support part 861*c* is located within the cavity of the first bar-shaped protrusion 86 and has one end connected with an inner wall of the first bar-shaped protrusion 86 and the other end connected with the limiting part 861*b*. Under the effect of the elastic support part 861*c*, the first positioning pin 861 always trends to extend through the opening in the first bar-shaped protrusion 86 and protrude from the surface of the first bar-shaped protrusion 86. The second positioning pin is located in a cavity of the second bar-shaped protrusion 87, is movable along a direction perpendicular to the installing direction of the cashbox (i.e. the up-and-down direction as shown in FIG. 5), and is configured to match with the second notch 271 in the second slot 27 in a plugging manner or be separated from the second notch 271 in the second slot 27. The structure and operation principles of the second positioning pin are similar to the structure and operation principles of the first positioning pin, and will not be described again herein.

The money recognizing mechanism 1 is fixedly connected with the bracket 8, and is located between the left side wall 81 and the right side wall 82 and above the intermediate plate 85. A money inlet A2, which is in communication with the money inlet on the panel (not shown) of the self-service terminal device, is arranged at the front end of the money recognizing mechanism 1, and a money outlet (not shown) is arranged at the bottom of the money recognizing mechanism 1, so that money can be put into the inside of the money recognizing mechanism 1 via the money inlet A2 of the money recognizing mechanism 1, as such, the money recognized and identified as genuine money is transferred to the inside of the cashbox for storage via the money outlet, and the money recognized and identified as fake money is retreated from the self-service terminal device via the money inlet A2.

The structure of the cashbox 2 is the same as that described in the above embodiment and will not be described again herein. The cashbox 2 is detachably connected with the bracket 8. When the cashbox 2 is installed in the bracket 8, the cashbox 2 is located between the bottom plate 84 and the intermediate plate 85 of the bracket 8 and between the left side wall 81 and the right side wall 82, the upper surface of the top wall 23 of the cashbox 2 abuts on the lower surface of the intermediate plate 85 of the bracket 8, the left box wall 21 and the right box wall 22 of the cashbox 2 respectively abut on the left side wall 81 and the right side wall 82 of the bracket 8, and the lower surface of the bottom wall of the cashbox 2 abuts on the upper surface of the bottom plate 84 of the bracket 8. The money inlet Al of the cashbox 2 is connect to the money outlet of the money recognizing mechanism 1, so that the money identified as genuine can be entered from the money outlet of the money recognizing mechanism 1 into the inside of the cashbox 2 for storage via the money inlet Al of the cashbox 2.

Figure 6:
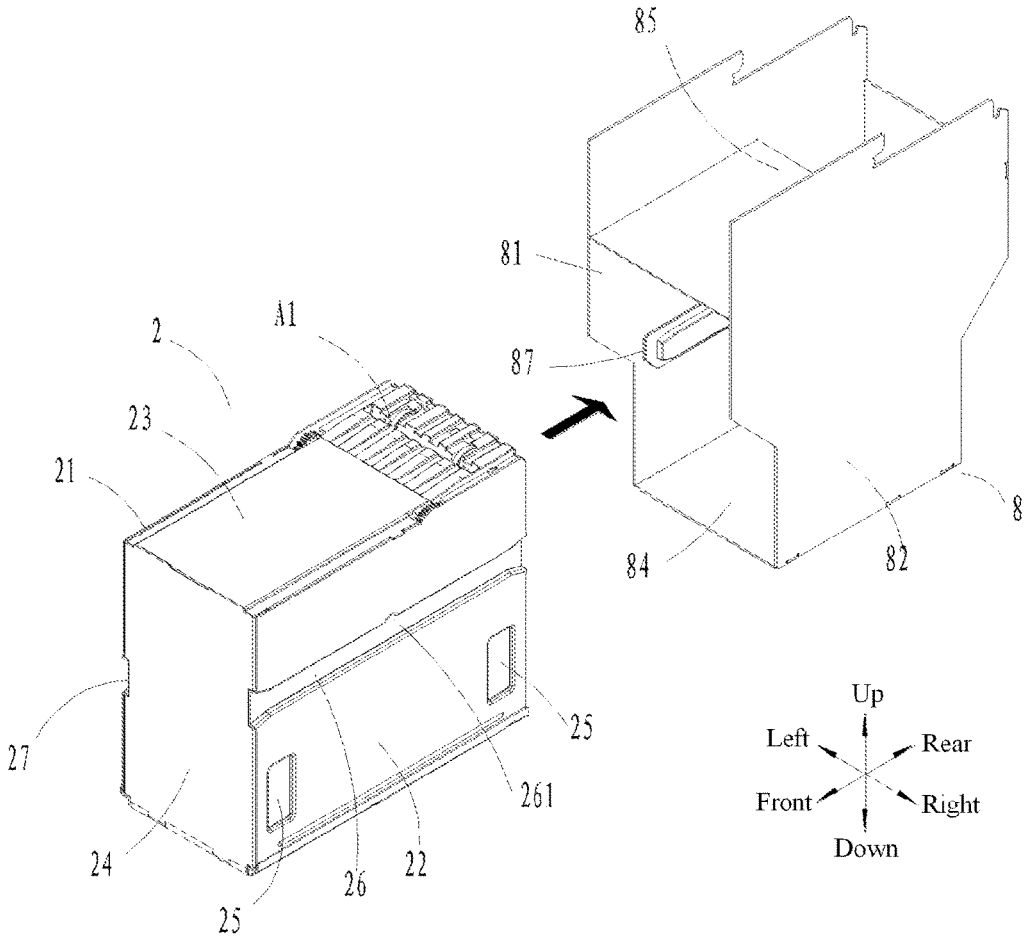
FIG. 6 is a view of installing of the cashbox into the self-service terminal device using the cashbox according to the embodiment of the present disclosure, where the cashbox is installed from a front side of the self-service terminal device.

Subsequently, processes of installing the cashbox into and detaching the cashbox from the self-service terminal device are described below. FIG. 6 is a schematic diagram showing installing of the cashbox into the self-service terminal device using the cashbox according to the embodiment of the present disclosure, where the cashbox is installed from the front side of the self-service terminal device.

As shown in FIG. 6, when the self-service terminal device is maintained at its front side and requires the cashbox to be installed into the bracket 8 from the front side of the bracket 8, in order to install the cashbox, a user holds those two handling recesses 25 on the left box wall 21 and the right box wall 22 of the cashbox 2 close to the front box wall 24, aligns the first slot 26 and the second slot 27 on the cashbox 2 with the first bar-shaped protrusion 86 and the second bar-shaped protrusion 87 on the bracket 8, respectively, and moves the cashbox 2 in the front-to-rear direction, so that the tapered beginning parts of the first slot 26 and the second slot 27 on the cashbox 2 firstly contact the first bar-shaped protrusion 86 and the second bar-shaped protrusion 87 on the bracket 8, respectively, and guide the first bar-shaped protrusion 86 to match with the first slot 26 in a plugging manner and guide the second bar-shaped protrusion 87 to match with the second slot 27 in a plugging manner, thus limiting the movement of the cashbox 2 in the up-and-down direction and a right-and-left direction relative to the bracket 8. During the movement of the cashbox 2 in the front-to-rear direction, the first slot 26 and the second slot 27 press the first positioning pin 861 and the second positioning pin, respectively, to retract the first positioning pin 861 and the second positioning pin into the cavities; when the first notch 261 in the first slot 26 aligns with the first positioning pin 861 and the second notch 271 in the second slot 27 aligns with the second positioning pin, the first positioning pin 861 and the second positioning pin are inserted into the first notch 261 and the second notch 271, respectively, under the effect of the elastic force applied by the elastic support part, and the first positioning pin 861 always match with the first notch 261 in a plugging manner and the second positioning pin always match with the second notch 271 in a plugging manner under the effect of the elastic force applied by the elastic support part, so that the movement of the cashbox 2 in the front-and-rear direction relative to the bracket 8 is limited, and the position of the cashbox 2 relative to the bracket 8 is fixed. At this point, the money inlet A1 on the top wall 23 of the cashbox 2 is connected to the money outlet of the money recognizing mechanism 1. In this way, the money identified as genuine can be entered from the money outlet of the money recognizing mechanism 1 into the inside of the cashbox 2 via the money inlet A1 of the cashbox 2, and the cashbox 2 operates normally.

To detach the cashbox 2, the user holds those two handling recesses 25 on the left box wall 21 and the right box wall 22 of the cashbox 2 close to the front box wall 24, and pulls the cashbox 2 in a rear-to-front direction, thus the first slot 26 and the second slot 27 press the first positioning pin 861 and the second positioning pin, respectively, so that the first positioning pin 861 and the second positioning pin are retracted into the cavities, and the cashbox 2 can be detached from the bracket 8 after the cashbox 2 is further pulled.

Figure 7:
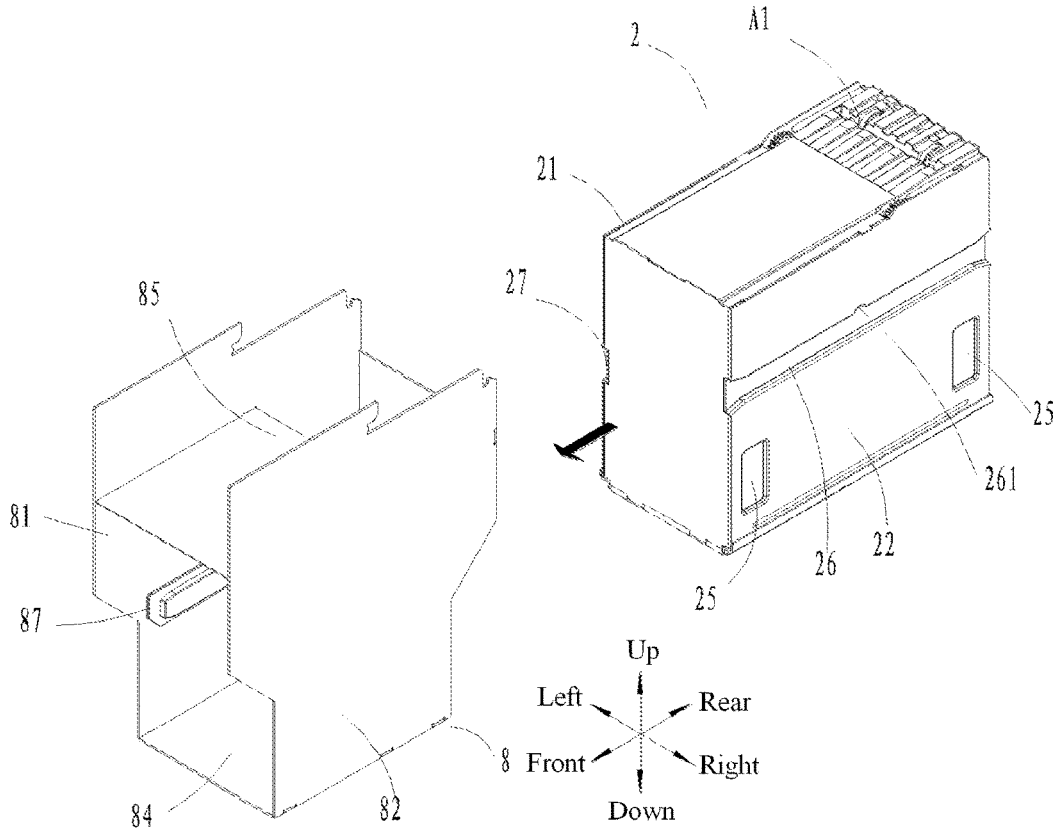
FIG. 7 is a view of installing of the cashbox into the self-service terminal device using the cashbox according to another embodiment of the present disclosure, where the cashbox is installed from a rear side of the self-service terminal device.

FIG. 7 is a schematic diagram showing installing of the cashbox into the self-service terminal device using the cashbox according to another embodiment of the present disclosure, where the cashbox is installed from the rear side of the self-service terminal device. As shown in FIG. 7, when the self-service terminal device is maintained at its rear side, the self-service terminal device requires the cashbox to be installed into the bracket 8 from the rear side of the bracket 8. The self-service terminal device maintained at its rear side is installed in such a way that the position of the money inlet A1 of the cashbox 2 relative to the bracket 8 is unchanged compared with the self-service terminal device maintained at its front side, so that the money inlet A1 of the cashbox 2 installed into the bracket 8 corresponds to the money outlet of the money recognizing mechanism 1.

To install the cashbox, a user holds those two handling recesses 25 on the left box wall 21 and the right box wall 22 of the cashbox 2 close to the rear box wall, aligns the first slot 26 and the second slot 27 on the cashbox 2 with the first bar-shaped protrusion 86 and the second bar-shaped protrusion 87 on the bracket 8, respectively, and moves the cashbox 2 in the rear-to-front direction, so that the first slot 26 and the second slot 27 on the cashbox 2 respectively match with the first bar-shaped protrusion 86 and the second bar-shaped protrusion 87 in a plugging manner. Along with the further movement of the cashbox 2, the first positioning pin 861 and the second positioning pin on the bracket 8 are inserted into the first notch 261 and the second notch 271 on the cashbox 2, respectively, under the effect of the elastic force applied by the elastic support part 861*c*, thereby fixing the position of the cashbox 2. At this point, the money inlet Al on the top wall 23 of the cashbox 2 is connected to the money outlet of the money recognizing mechanism 1. In this way, the money identified as genuine can be entered from the money outlet of the money recognizing mechanism 1 into the inside of the cashbox 2 via the money inlet Al of the cashbox 2, and the cashbox 2 operates normally.

To detach the cashbox 2, the user holds those two handling recesses 25 on the left box wall 21 and the right box wall 22 of the cashbox 2 close to the rear box wall, and pulls the cashbox 2 in a front-to-rear direction, thus the first slot 26 and the second slot 27 press the first positioning pin 861 and the second positioning pin, respectively, so that the first positioning pin 861 and the second positioning pin are retracted into the cavities, and the cashbox 2 can be detached from the bracket 8 after the cashbox 2 is further pulled.

The cashbox disclosed in the present disclosure is adopted in the self-service terminal device in the present embodiment. The cashbox is applicable to both the self-service terminal device maintained at the front side and the self-service terminal device maintained at the rear side, so that the usage cost of the self-service terminal device is reduced. Moreover, in installing the cashbox, it is necessary that the money inlet of the cashbox corresponds to the money outlet of the money recognizing mechanism installed in the bracket, so that the first guide member on the cashbox matches with the second guide member on the bracket in a plugging manner, thereby avoiding a problem of reversed installation of the cashbox due to a change of the installation direction of the cashbox, ensuring the normal usage of the self-service terminal device, and improving the reliability of the self-service terminal device.

Some preferred embodiments of the present disclosure have been described as above, but the scope of the present disclosure is not limited thereto, and various modifications and alternations may be made to the present disclosure by those of ordinary skills in the art. Any modifications, equivalent replacements and improvements made without departing from the spirit and principles of the present disclosure fall within the scope of the present disclosure.

The invention claimed is:

1. A cashbox for insertion in a self-service terminal device, the cashbox having a rectangular cuboid structure, wherein external walls of the cashbox comprise a left box wall (21) and a right box wall (22) arranged oppositely, a front box wall (24) and a rear box wall arranged oppositely, and a top wall (23) and a bottom wall arranged oppositely, wherein slots (26; 27) are respectively provided on two of the external walls arranged oppositely, and where the slot (26; 27) extend parallel to an inserting direction of the cashbox, and both ends of each of the slots (26; 27) open at the opposing edges of the respective external wall;

wherein the location of the two slots (26; 27) are staggered in a direction perpendicular to the inserting direction of the cashbox, to prevent reversed installation of the cashbox.

2. The cashbox of claim 1, wherein one slot (26) of the two slots (26; 27) is arranged on the left box wall (21) and the other slot (27) of the two slots (26; 27) is arranged on the right box wall (22), and the location of the two slots (26; 27) on the left box wall (21) and the right box wall (22) are staggered in the direction perpendicular to the inserting direction.

3. The cashbox of claim 1, wherein each of the opening of both ends of each of the slots (26; 27) has a tapered shape.

4. The cashbox of claim 1, wherein handling recesses (25) configured for inserting and pulling the cashbox and formed by recessed regions are arranged on the external walls.

5. The cashbox of claim 1, wherein a positioning notch (261; 271) or a retractable positioning pin is arranged on an upper or lower edge of each of the slots (26; 27).

6. A self-service terminal device comprising the cashbox (2) of claim 1, and further comprising a money recognizing mechanism (1), and a bracket (8) for installing the money recognizing mechanism (1) and the cashbox (2), wherein bar-shaped protrusions (86; 87) arranged on the bracket (8) are configured to slidably cooperate with the slots (26; 27).

7. The self-service terminal device of claim 6, wherein one of a positioning notch (261; 271) and a retractable positioning pin is arranged on an upper or lower edge of each of the slots (26; 27), the other of the positioning notch (261; 271) and the retractable positioning pin is arranged on the bar-shaped protrusions (86; 87), and the positioning notch (261; 271) and the retractable positioning pin are configured to match with each other in a plugging manner or separate from each other.

8. The self-service terminal device of claim 6, wherein the bracket (8) comprises a left side wall (81), a right side wall (82), a bottom plate (84) and an intermediate baffle plate (85), the money recognizing mechanism (1) is located above the intermediate baffle plate (85) and between the left side wall (81) and the right side wall (82), the cashbox (2) is located below the intermediate baffle plate (85) and between the left side wall (81) and the right side wall (82), handling recesses (25) configured for inserting and pulling the cashbox (2) and formed by recessed regions are arranged on the left box wall (21) and the right box wall (22) of the cashbox (2), and collision-avoiding notches (811; 821) configured to avoid a collision with the handling recesses (25) are arranged on the left side wall (81) and the right side wall (82).

9. A self-service terminal device, comprising a bracket (8), and a money recognizing mechanism (1) and a cashbox (2) inserted in the bracket (8), wherein two slots (26; 27) are arranged on the cashbox (2), and bar-shaped protrusions (86; 87) configured to slidably cooperate with the slots (26; 27) arranged on the bracket (8), the slots (26; 27) are located on two opposite walls of the cashbox(2) which are external walls of the cashbox (2), the slots (26;27) extend parallel to an inserting direction of the cashbox (2) and both ends of each of the slots (26;27) open at the opposing edges of the respective external wall, and the location of the two slots (26; 27) are staggered in a direction perpendicular to the inserting direction, to prevent reversed installation of the cashbox (2).

* * * * *